United States Patent [19]

Winter

[11] Patent Number: 4,850,592

[45] Date of Patent: Jul. 25, 1989

[54] MOUSE MAZE GAME

[76] Inventor: Jerry A. Winter, 1012-6 Avenue South, Lethbridge, Alberta, Canada, T1J 0Z9

[21] Appl. No.: 178,308

[22] Filed: Apr. 6, 1988

[51] Int. Cl.[4] ..... A63B 67/14; A63B 71/00; A63F 9/06

[52] U.S. Cl. ..... 273/109; 273/153 R; 273/128 R

[58] Field of Search ..... 273/109, 153 R, 110, 273/115, 128 R

[56] References Cited

U.S. PATENT DOCUMENTS

| | | | |
|---|---|---|---|
| D. 169,672 | 5/1953 | Hopkins | 272/19 |
| 545,678 | 9/1895 | Castan | 272/19 |
| 760,032 | 5/1904 | Snedeker | 272/19 |
| 3,712,617 | 1/1973 | Ohlschlager | 272/19 |
| 4,103,895 | 8/1978 | Pressman et al. | 273/153 R |
| 4,252,320 | 2/1981 | Rouse | 272/243 |
| 4,258,918 | 3/1981 | Nishimiya | 273/110 |
| 4,311,310 | 1/1982 | Dankman et al. | 273/109 |
| 4,511,143 | 4/1985 | Sankrithi | 273/153 R |

FOREIGN PATENT DOCUMENTS

| | | | |
|---|---|---|---|
| 0936955 | 6/1982 | U.S.S.R. | 273/115 |

*Primary Examiner*—Edward M. Coven
*Assistant Examiner*—Gary Jackson
*Attorney, Agent, or Firm*—Jerry T. Kearns

[57] ABSTRACT

A mouse maze game includes a rectangular bottom maze board having a recessed central rectangular maze area with pairs of transversely extending longitudinally spaced electrical contact strips. An array of spaced holes are provided in the maze area, between the pairs of electrical contact strips. Pegs are inserted in the holes, and various maze patterns are formed by stretching elastic bands between the pegs to form maze walls. A rectangular top maze board with a recessed bottom surface is removably secured in overlying relation over the bottom maze board, forming a hidden maze area. Pairs of transversely spaced electrical contact strips extend longitudinally from end to end within the recessed maze area on the bottom of the top maze board. Light bulbs are spaced around the periphery of the top maze board. A cylindrical disk shaped mouse having metallic contacts at each end is inserted into the recessed maze area formed between the top and bottom maze boards. The metallic contacts of the mouse bridge the spaced electrical contact strips on both the top and bottom maze boards, completing electrical circuits which illuminates certain ones of the light bulbs, providing an indication of the position of the mouse within the maze. The object of the game is to maneuver the mouse through the maze by tilting the assembled maze boards.

5 Claims, 4 Drawing Sheets

MOUSE MAZE GAME

BACKGROUND OF THE INVENTION

1. Field of the Invention

The present invention relates to maze games, and more particularly pertains to a new and improved mouse maze game. Conventional forms of maze games are played utilizing variously configured lines printed on paper. A player attempts to create a pencil line completely through the array of lines. This type of game is disadvantageous because it affords little challenge as the individual has a clear view of the maze configuration. In order to provide a more challenging maze game, the present invention provides a maze game in which the configuration of the maze may be selectively altered and which remains hidden from the view of the player.

2. Description of the Prior Art

Various types of maze games are known in the prior art. A typical example of such a maze game is to be found in U.S. Pat. No. 545,678, which issued to G. Castan on Sept. 3, 1895. This patent discloses an arrangement of an array of mirrors for creating the illusion of a labyrinth passage within a room. U.S. Pat. No. 760,032, which issued to A. Snedeker on May 17, 1904, discloses a puzzle which utilizes a labyrinth passage. The labyrinth is formed in a large building provided with various passages. Certain ones of the passages terminate blindly, with no apparent exit after leading in or out. One of the passages is continuous and leads from the entrance to a prize chamber or compartment. The object of the game is to successfully pass through the continuous passage to the prize chamber. U.S. Pat. No. 169,672, which issued to R. Hopkins on May 26, 1953, discloses a maze game which utilizes a tiltable game board. A user attempts to manipulate a ball through a maze on the game board by operating tilting mechanisms provided on one end and on one side of the game board. The game board may thus be tilted into perpendicular directions. U.S. Pat. No. 3,712,617, which issued to N. Ohlschlager on Jan. 23, 1973, discloses a maze game for play by a plurality of players. The game apparatus comprises movable components to change the pattern of the maze on the game board. A pulley system is provided beneath the game board for moving a magnet in either direction of the X coordinate, in either direction of the Y coordinate and any resultant direction therebetween. The movement of the magnet beneath the game board attracts a freely movable metallic ball on the game board to follow through the maze. A plurality of knobs are provided on the game board, each of which controls the movement of the magnet in an X coordinate direction and a Y coordinate direction so that a plurality of players may participate by controlling the movement of the magnet in a coordinate direction with the result that all players must cooperate to lead the ball through the maze. U.S. Pat. No. 4,252,320, which issued to G. Rouse on Feb. 24, 1981, discloses a game board apparatus for play by a plurality of players which includes a game board bearing a substantially rectangular maze thereon. The maze is divided into a number of spaces or steps and includes a number of blocked positions. Residence strips formed on the game board delineate three adjacent sides of the maze. A number of starting positions are delineated on the remaining four sides of the maze. Play of the game is dictated by dice. A marker is placed on one of the residence positions on each of the three residence strips.

The marker is designated as a residence. The object of the game is to move the marker or token from a starting position through the maze to visit the space directly in front of a residence. The dice also determine the opportunity for a player to place or move a blocking mark into the blocking position on the maze and thereby impede the movement of the other players'token.

While the above mentioned devices are suited for their intended usage, none of these devices utilize a plurality of spaced electrical contact strips to selectively illuminate an array of light bulbs to provide an indication of the position of a mouse within a hidden maze. Additionally, none of the aforesaid devices provide a hidden maze area which utilizes a plurality of pegs and elastic bands for selectively determining the maze configuration. Inasmuch as the art is relatively crowded with respect to these various types of maze games, it can be appreciated that there is a continuing need for and interest in improvements to such maze games, and in this respect, the present invention addresses this need and interest.

SUMMARY OF THE INVENTION

In view of the foregoing disadvantages inherent in the known types of maze games now present in the prior art, the present invention provides an improved mouse maze game. As such, the general purpose of the present invention, which will be described subsequently in greater detail, is to provide a new and improved mouse maze game which has all the advantages of the prior art maze games and none of the disadvantages.

To attain this, a representative embodiment of the concepts of the present invention is illustrated in the drawings and makes use of a bottom maze board which has a generally rectangular configuration. A recessed central rectangular maze area is provided with a plurality of pairs of transversely extending longitudinally spaced electrical contact strips. A plurality of longitudinally spaced rows of peg receiving holes extend transversely across the maze area, between the pairs of electrical contact strips. A plurality of pegs dimensioned for removable retention within the spaced peg receiving holes are provided. Various maze patterns may be formed by positioning these pegs in selected ones of the peg receiving holes and stretching elastic bands between the pegs to form maze walls. A generally rectangular top maze board has a recessed underside which is adapted to overlay the recessed maze area of the bottom maze board. A plurality of pairs of transversely spaced electrical contact strips extend longitudinally from end to end within the recessed maze area on the underside of the top maze board. A plurality of electric light bulbs are spaced around the periphery of the top maze board. When the top and bottom maze boards are assembled, the electrical contact strips of the top maze board and bottom maze board extend in spaced perpendicular relation. When the top and bottom maze boards are assembled in overlying relation, the maze formed in the maze area of the bottom maze board is hidden from view. A cylindrical disk shaped mouse having metallic contacts at each end is inserted into the recessed maze area formed between the top and bottom maze boards. The metallic contacts at each end of the mouse bridge the spaced electrical contact strips on both the top and bottom maze boards, completing electrical circuits which illuminates certain ones of the electric light bulbs, providing an indication of the position of the mouse within the maze. The object of the game is to maneuver the mouse through the maze by tilting the assembled maze boards.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved mouse maze game which has all the advantages of the prior art maze games and none of the disadvantages.

It is another object of the present invention to provide a new and improved mouse maze game which may be easily and efficiently manufactured and marketed.

It is a further object of the present invention to provide a new and improved mouse maze game which is of a durable and reliable construction.

An even further object of the present invention is to provide a new and improved mouse maze game which is susceptible of a low cost of manufacture with regard to both materials and labor, and which accordingly is then susceptible of low prices of sale to the consuming public, thereby making such maze games economically available to the buying public.

Still yet another object of the present invention is to provide a new and improved mouse maze game which provides in the apparatuses and methods of the prior art some of the advantages thereof, while simultaneously overcoming some of the disadvantages normally associated therewith.

Still another object of the present invention is to provide a new and improved mouse maze game which utilizes a plurality of spaced pairs of perpendicularly extending electrical contact strips in conjunction with an array of electric light bulbs to provide an indication of the position of a mouse within a hidden maze.

Yet another object of the present invention is to provide a new and improved mouse maze game which utilizes a game board having a recessed maze area provided with a rectangular matrix array of spaced peg receiving holes in conjunction with a plurality of pegs and elastic bands for selectively determining the configuration of a maze.

Even still another object of the present invention is to provide a new and improved mouse maze game which utilizes a hidden maze in conjunction with a tiltable game board to provide an improved maze game.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above Will become apparent when consideration is given to the following detailed description thereof. Such description makes reference to the annexed drawings wherein.

DESCRIPTION OF THE PREFERRED EMBODIMENT

Figure 1:
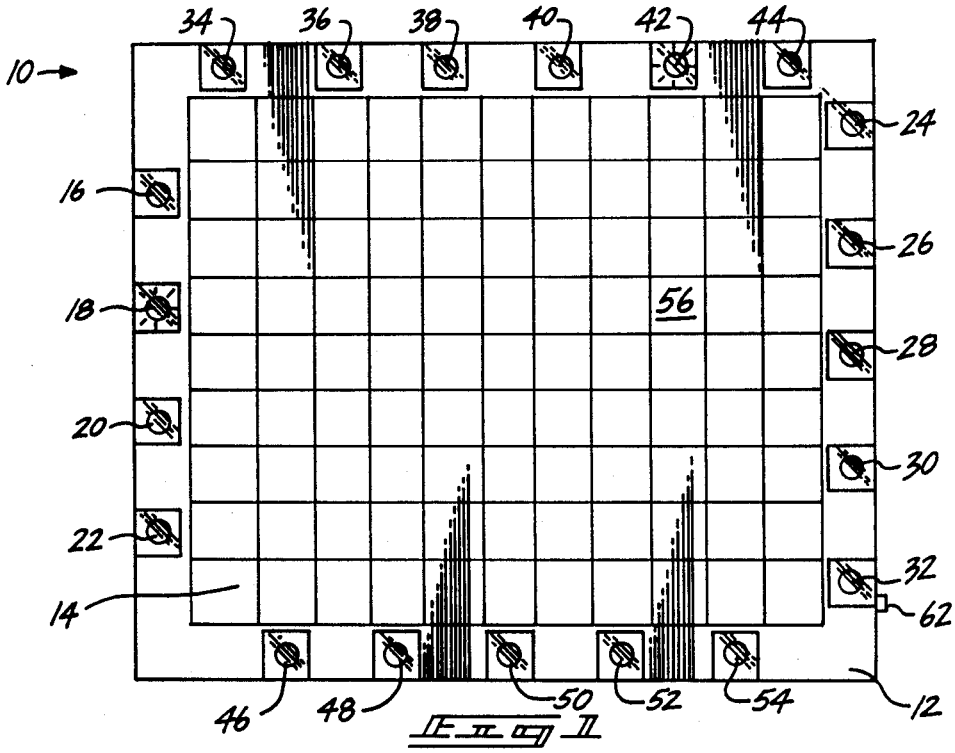
FIG. 1 is a top view of the mouse maze game of the present invention.

With reference now to the drawings, and in particular to FIG. 1 thereof, a new and improved mouse maze game embodying the principles and concepts of the present invention and generally designated by the reference numeral 10 will be described.

More specifically, it will be noted that the first embodiment 10 of the invention includes a rectangular top maze board 12 having a grid 14 printed on an upper surface thereof. A plurality of electric light bulbs are spaced around the periphery of the top maze board 12. The nine light bulbs 16, 18, 20, 22, 24, 26, 28, 30 and 32, spaced along the ends of the top maze board 12 are connected to nine pairs of electrical contact strips which extend from left to right along the length of the underside of the top maze board 12. These nine pairs of electrical contact strips are transversely spaced from top to bottom on the underside of the top maze board 12. The eleven light bulbs 34, 36, 38, 40, 42, 44, 46, 48, 50, 52 and 54, which are spaced along the sides of the top maze board 12 are connected to eleven pairs of electrical contact strips which extend transversely across the width in the interior of a bottom maze board. These eleven pairs of electrical contact strips are spaced from left to right along the length of the bottom maze board, which is situated beneath the top maze board 12 of FIG. 1. Thus, these twenty light bulbs form an indicator grid for indicating the location of a "mouse" received between the top 12 and bottom maze boards. For example, when the "mouse" is situated beneath the grid square 56 of the top maze board 12, the light bulbs 18 and 42 will be illuminated.

Figure 2:
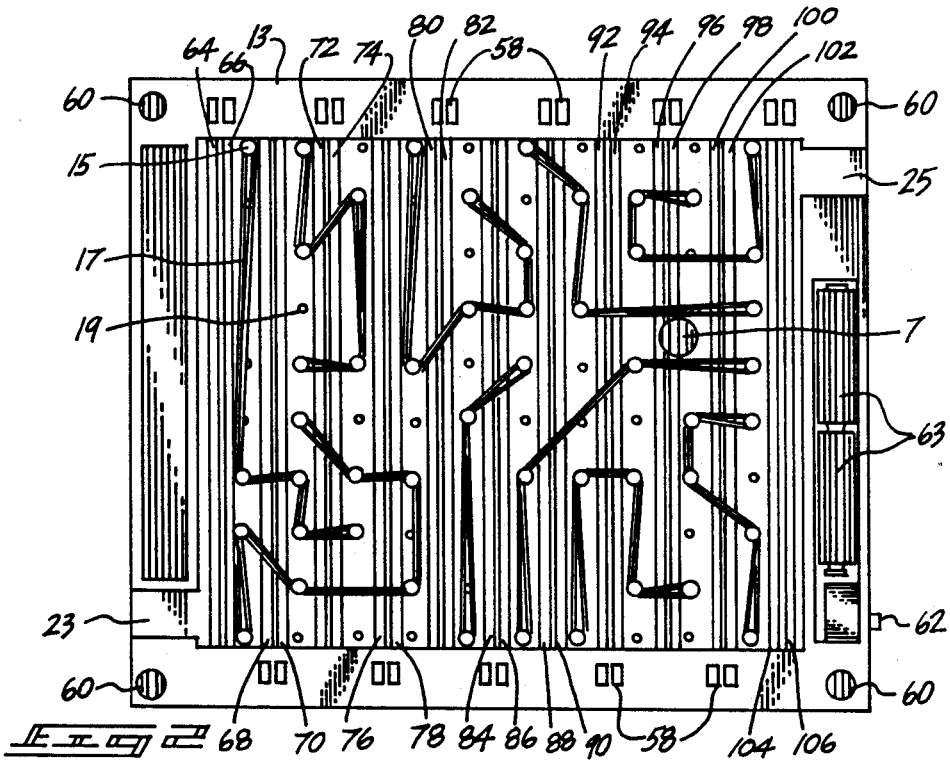
FIG. 2 is a top view of the bottom maze board of the present invention, with the top maze board removed.

With reference now to FIG. 2, a top view of the bottom maze board 13 is provided, the top maze board 12 having been removed. The eleven pairs of spaced electrical contacts 64, 66, 68, 70, 72, 74, 76, 78, 80, 82, 84, 86, 88, 90, 92, 94, 96, 98, 100, 102, 104 and 106 are disposed on the floor of a rectangular recess formed in the bottom maze board 13. These eleven pairs of electrical contacts strips extend transversely across the bottom and are evenly spaced along the length thereof, as illustrated. A rectangular array of peg receiving holes 19 are disposed between the pairs of electrical contact strips. A plurality of pegs 15 are situated in a predetermined configuration in the holes 19. A plurality of elastic bands 17 are stretched between and around the various pegs 15 to form a maze configuration. A mouse 7 in the form of a cylindrical disk is maneuvered from an entrance slot 23 through the maze configuration to an exit slot 25. The mouse 7 has metallic insulated electrical contact opposite end portions which bridge the pairs of electrical contact strips, completing an electrical circuit. For example, in the illustrated position, the mouse 7 is bridging the electrical contacts strips 96 and 98, thus illuminating the corresponding light bulb 42 (FIG. 1). One of each adjacent pair of these electrical contact strips is connected to one side of the batteries 63. The other of each pair of adjacent electrical contact strips is connected to one of the light bulbs. Thus, the mouse 7 completes an electrical circuit from the batteries to the corresponding light bulb. A switch 62 is provided for disconnecting the batteries 63 from the circuit. Four upstanding cylindrical alignment pins 60 are situated adjacent each corner of the bottom maze board 13 for registry with corresponding cylindrical recesses provided adjacent bottom corner portions of the top maze board 12. In this fashion, the top maze board 12 may be secured in aligned overlying relationship on the bottom maze board 13 after the desired maze configuration has been set up utilizing the pegs 15 and elastic bands 17. When assembled, the maze configuration is hidden from view. The mouse 7 is then inserted into the entrance slot 23 into the recessed maze area. By tilting the assembled top 12 and bottom 13 maze boards, the mouse 7 may be maneuvered through the maze to the exit slot 25. The game of the present invention is adapted for play by two or more players, with one player setting up the maze configuration and another player attempting to solve the maze by manipulating the mouse 7 from the entrance slot 23 to the exit slot 25. The player attempting to manipulate the mouse 7 through the maze is assisted by the illumination of the various light bulbs spaced around the periphery of the upper maze board 12. These various light bulbs provide an indication of the current position of the mouse 7. Additionally, when the assembled maze boards 12 and 13 are tilted, the mouse 7 will make an audible sound when the mouse 7 is in motion. If no sound can be heard, it can be inferred that the mouse 7 is in an obstructed location. The various players may compete against a clock to determine the quickest maze solution time. Spaced upstanding electrical connectors 58 serve to connect the eleven spaced electrical contact strips on the bottom maze board 13 to the electric light bulbs spaced around the periphery of the top maze board 12. The electrical connectors 58 may be of any conventional form.

Figure 3:
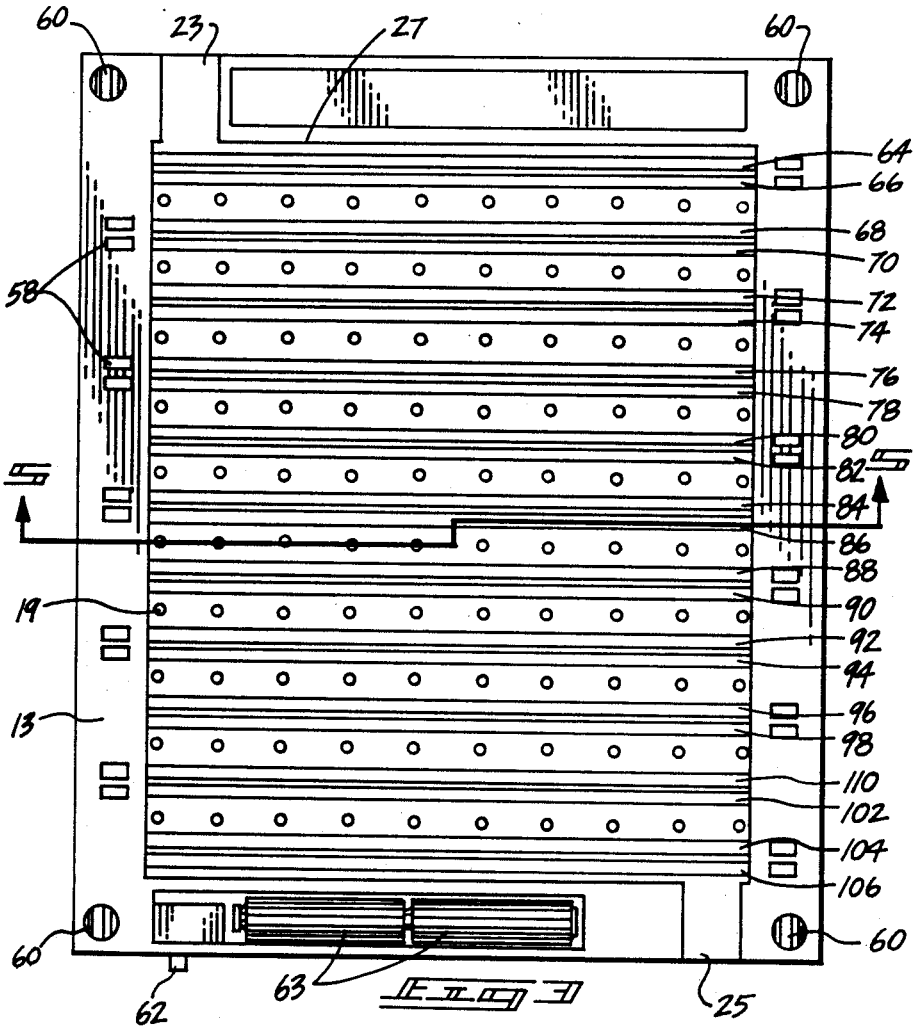
FIG. 3 is an enlarged top view of the bottom maze board, with the maze forming pegs and elastic bands removed.

With reference now to FIG. 3, an enlarged top view of the bottom maze board 13 is provided. The maze forming pegs 15 and elastic bands 17 have been removed for clarity of illustration. As previously described, the eleven spaced pairs of electrical contact strips and array of peg receiving holes 19 are disposed within a rectangular recessed maze area in the bottom maze board 13. This recessed area is delineated by an upstanding perimeter side wall 27.

Figure 4:
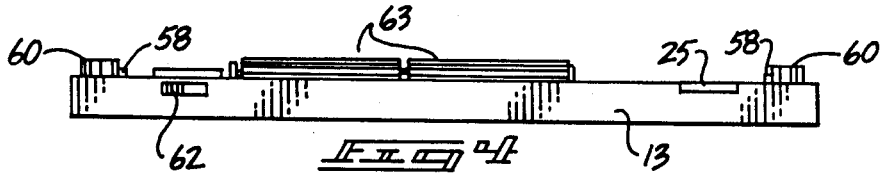
FIG. 4 is an end view of the bottom maze board.

In FIG. 4, an end view of the bottom maze board 13 is provided. The exit slot 25 shown in FIG. 4 mates with a corresponding slot portion formed in the upper maze board 12.

Figure 5:
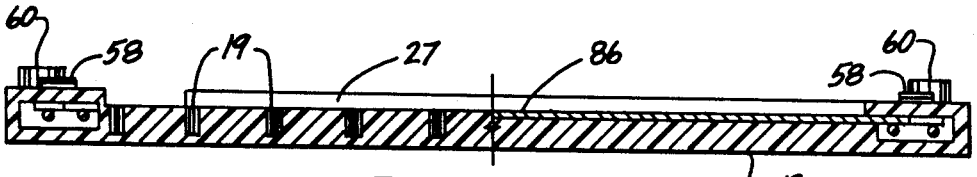
FIG. 5 is a transverse cross sectional view, taken along line 5—5 of FIG. 3, illustrating the construction of the bottom maze board.

In FIG. 5, a cross sectional view taken along line 5—5 of FIG. 3, illustrates the constructional details of the bottom maze board 13. The bottom maze board 13 is preferably formed from a plastic material. The peg receiving holes 19 extend into the upper floor surface of the interior recessed maze area of the bottom maze board 13. The various electrical contact strips are set into the upper surface of the bottom maze board 13 so as to have an upper surface flush with the top surface of the maze area. This allows the mouse 7 to slide freely without resistance along the upper surface of the bottom maze board 13.

Figure 6:
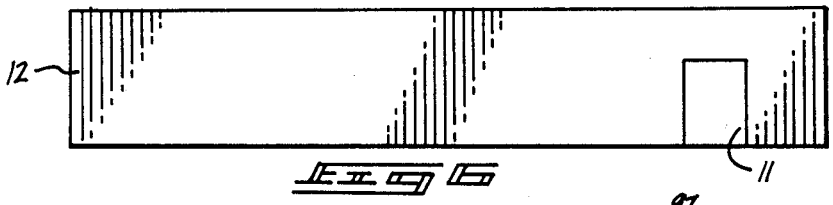
FIG. 6 is an end view of the top maze board.

In FIG. 6, an end view of the upper maze board 12 is provided. A top entrance slot portion 11 is formed in the end wall of the top maze board 12. This slot portion 11 is adapted for cooperation with the bottom entrance slot portion 23 of the bottom maze board 13.

Figure 7:
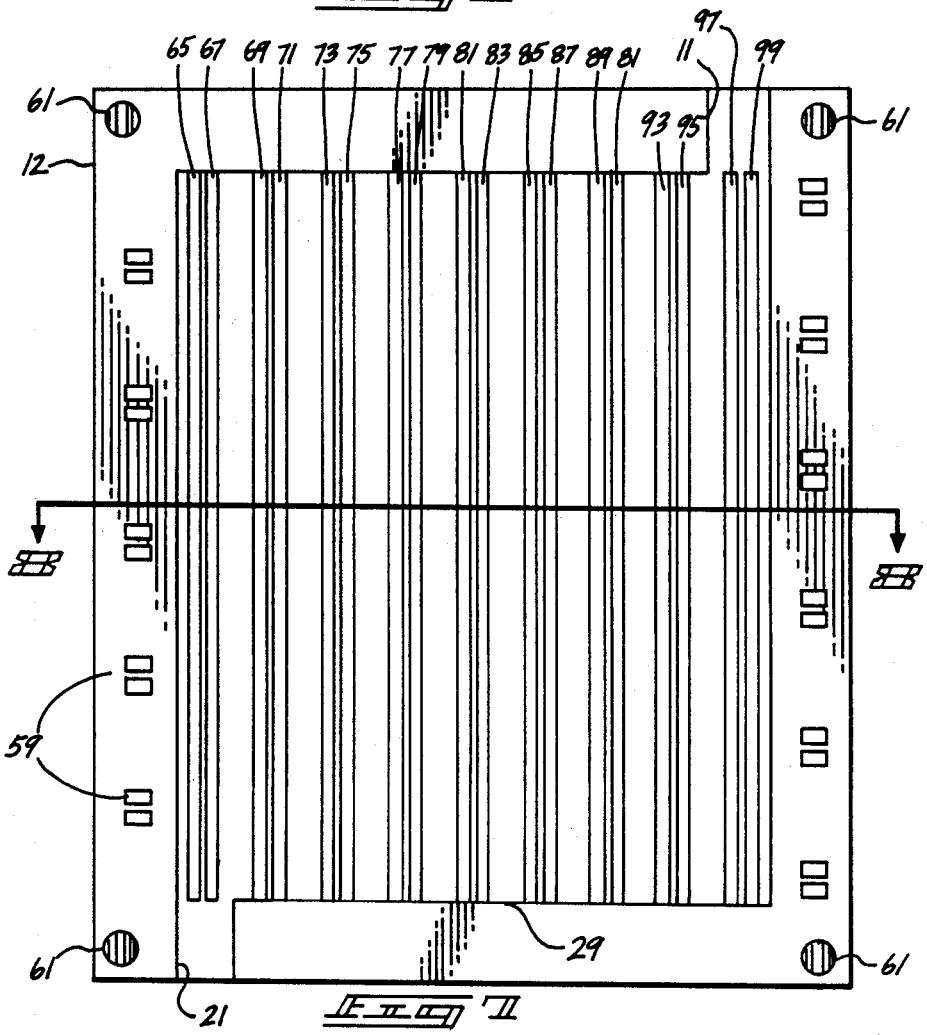
FIG. 7 is a bottom view of the top maze board.

In FIG. 7, a bottom view of the top maze board 12 is provided. The top maze board 12 has a rectangular recessed maze area provided with nine pairs of spaced electrical contact strips 65, 67, 69, 71, 73, 75, 77, 79, 81, 83, 85, 87, 89, 91, 93, 95, 97 and 99. These nine pairs of electrical contact strips extend along the length of the top maze board 12 and are evenly transversely spaced across the width thereof. As may now be understood, when the top maze board 12 is assembled in overlying relationship on the bottom maze board 13, the nine pairs of electrical contact strips on the top maze board 12 will extend perpendicularly to the eleven pairs of electrical contact strips on the bottom maze board 13. These twenty pairs of electrical contact strips form an electrical indicating grid for indicating the position of the mouse 7 within the maze playing area. The rectangular recessed maze playing area of the top maze board 12 is delineated by a peripheral upstanding side wall 29. The top maze board 12 has an exit slot portion 21 formed in an end wall opposite the entrance slot portion 11. A plurality of electrical connectors 59 are spaced along the sides on the under surface of the top maze board 12 for registry with the electrical contacts 58 of the bottom maze board 13. Four cylindrical recessed sockets 61 are disposed adjacent each corner of the top maze board 12 for registry with the alignment pins 60 of the bottom maze board 13.

Figure 8B:
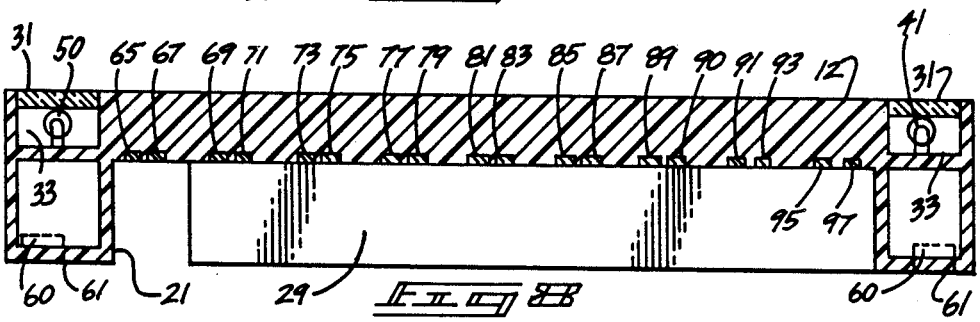
FIG. 8 is a transverse cross sectional view, taken along line 8—8 of FIG. 7, illustrating the construction of the top maze board.

As shown in the cross sectional view of FIG. 8, the nine pairs of electrical contact strips are flush with the recessed ceiling of the top maze board maze playing area. These various electrical contact strips are formed from a conducting material such as aluminum or copper. The top maze board 12 is preferably molded from a plastic material. As illustrated, the peripherally spaced light bulbs 50 and 40 are situated in recessed wells 33 which are covered by transparent glass or plastic lenses 31. The alignment pins 60 of the bottom maze board 13 are shown extending into the alignment sockets 61.

Figure 9:
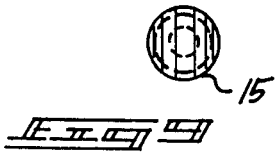
FIG. 9 is a top view of a maze forming peg.

In FIG. 9, a top view of the maze forming peg 15 is provided.

Figure 10:
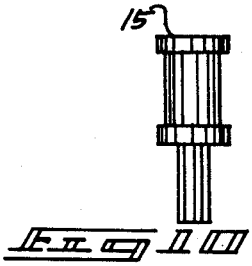
FIG. 10 is a side view of a maze forming peg.

In FIG. 10, a side view of the maze forming peg 15 is provided. A plurality of these pegs 15 are utilized in the maze game of the present invention, and may be situated as desired within the peg receiving holes 19 on the bottom maze board 13. Conventional elastic bands 17 are then stretched as desired around the pegs 15 to form maze walls.

Figure 11:
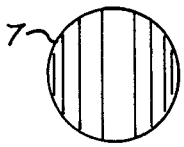
FIG. 11 is a top view of the mouse.

In FIG. 11, a top view of the mouse 7 is provided.

Figure 12:
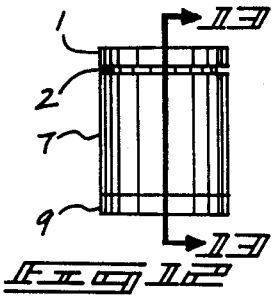
FIG. 12 is a side view of the mouse.

In FIG. 12, a side view of the mouse 7 is provided. The mouse 7 has opposite ends 1 and 9 which are formed from a metallic conducting material. These ends 1 and 9 are electrically insulated from one another by the plastic cylindrical side wall of the mouse 7. The upper end 1 of the mouse 7 has a stepped diameter cylindrical side wall 2 which is telescopically received within the main body portion of the mouse 7.

Figure 13:
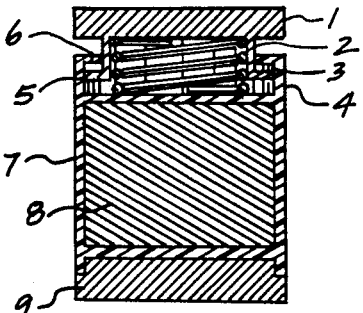
FIG. 13 is a longitudinal cross sectional view, taken along line 13—13 of FIG. 12, illustrating the construction of the mouse.

As shown in the cross sectional view of FIG. 13, a weak coil spring 3 biases the upper metallic contact 1 of the mouse 7 upwardly. The upper contact 1 has a circular annular rim 5 received within a cylindrical undercut recess 4 of the mouse 7. An annular ledge 6 captures the rim 5 within the recess 4. The purpose of this arrangement is to provide a weak spring force to urge the metallic contacts 1 and 9 of the mouse 7 against the electrical contact strips on the top 12 and bottom 13 maze boards. The spring 3 is sufficiently weak so as not to wedge the mouse 7 between the top 12 and bottom 13 maze boards. To ensure the free sliding of the mouse 7, a lead weight 8 is encapsulated within the plastic body portion of the mouse 7.

Figure 14:
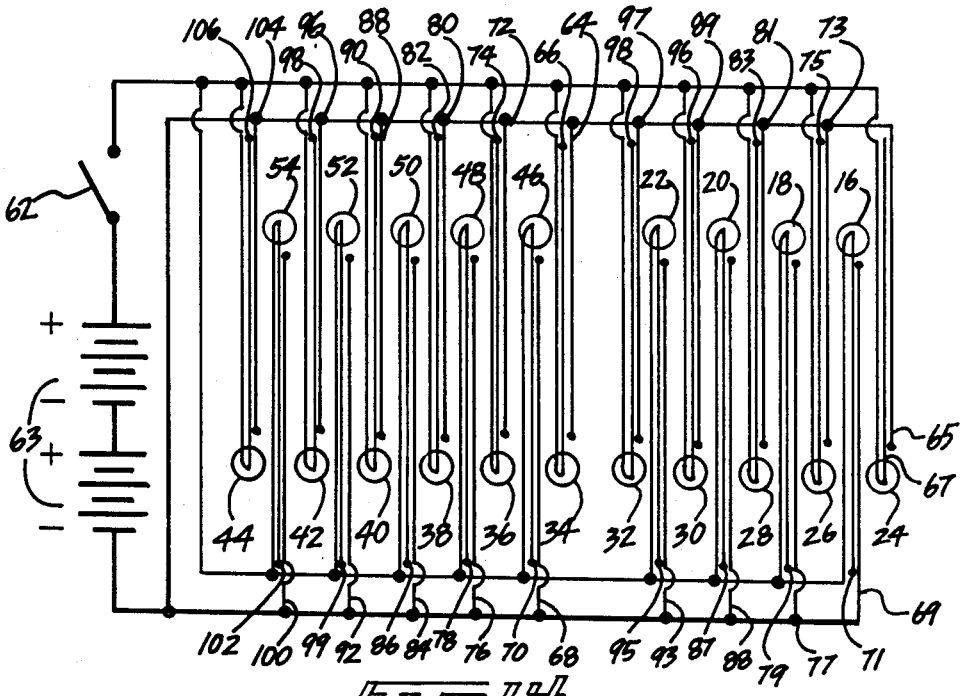
FIG. 14 is a schematic diagram, illustrating the electrical connections of the array of light bulbs spaced around the periphery of the top maze board.

In FIG. 14, a schematic diagram illustrating the electrical connection of the various components of the present invention is provided. As shown, one of each pair of adjacent electrical contact strips is connected to one terminal of a light bulb. The other of each pair of adjacent electrical contact strips is connected to one terminal of the battery 63. The opposite terminal of each light bulb is connected to the other terminal of the battery 63. Thus, when the mouse 7 bridges a pair of adjacent electrical contact strips, the corresponding light bulb will be illuminated. For example, when the adjacent pair of electrical contact strips 104 and 106 are bridged, the light bulb 44 will be illuminated. Of course, the switch 62 will be moved to a closed position before the beginning of each game. It should be noted that the spacing of the pairs of the electrical contact strips and the dimensions of the mouse 7 are selected to prevent shorting of adjacent pairs of contact strips.

While the preferred construction of the top 12 and bottom 13 maze boards is of a molded plastic, various other conventional materials may be utilized without departing from the scope of the present invention. Additionally, in place of the alignment pins 60 and alignment sockets 61, the top 12 and bottom 13 maze boards may be removably fastened together by a variety of other conventional mechanisms. For example, the top 12 and bottom 13 maze boards may be pivotally connected along one end or side edge by a hinge.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved mouse maze game, comprising:

rectangular top and bottom maze boards, each provided with a plurality of pairs of spaced electrical contact strips;

said pairs of electrical contact strips on said top maze board extending in spaced perpendicular relation to said electrical contact strips on said bottom maze board;

a plurality of electric indicator light means spaced around a periphery of an upper surface of said top maze board;

a recessed interior maze playing area formed on said bottom maze board;

means for selectively creating a maze configuration in said maze playing area;

means for removably securing said top and bottom maze boards in overlying relation;

mouse means dimensioned for passage through said maze configuration; and said mouse means having electrical contact means for bridging said electrical contact strips for illuminating selected ones of said indicator light means dependent upon a location of said mouse means in said maze configuration.

2. The mouse maze game of claim 1 wherein said mouse comprises a cylindrical disk having metallic electrical contacts at each end.

3. The mouse maze game of claim 2, further comprising spring means for outwardly biasing said electrical contacts.

4. A new and improved mouse maze game, comprising:

top maze board means;

a plurality of electric indicator light means spaced around a periphery of an upper surface of said top maze board means;

bottom maze board means;

a recessed interior maze playing area formed on said bottom maze board means;

an array of holes in said maze playing area;

a plurality of pegs for selective positioning in said holes;

a plurality of elastic bands extending between said pegs for selectively creating a maze configuration;

means for removably securing said top and bottom maze board means in overlying relation;

mouse means dimensioned for passage through said maze configuration; and means for illuminating selected ones of said indicator light means dependent upon a location of said mouse means in said maze configuration.

5. A new and improved mouse maze game, comprising:

a generally rectangular top maze board;

a plurality of electric indicator light means spaced around a periphery of an upper surface of said top maze board;

a grid printed on said upper top maze board surface;

a rectangular recessed portion formed on a bottom surface of said top maze board;

a plurality of pairs of spaced electrical contact strips extending across said rectangular recessed portion;

a generally rectangular bottom maze board;

a rectangular recessed maze playing area in said bottom maze board;

a plurality of pairs of spaced electrical contact strips extending across said maze playing area;

a plurality of peg receiving holes arranged in a rectangular array between said contact strips in said maze playing area;

a plurality of pegs removably received in various locations in said peg receiving holes;

a plurality of elastic bands extending between said pegs forming a maze configuration;

means removably securing said top and bottom maze boards in overlying relation to form a hidden maze playing area;

cooperating entrance and exit slot portions at opposite ends of each of said top and bottom maze boards;

a mouse formed as a cylindrical disk dimensioned for sliding movement within said maze playing area and having insulated metallic contacts at opposite end portions thereof;

spring means for outwardly biasing said insulated metallic contacts on said mouse; and means connecting said electrical contact strips on said top and bottom maze boards to said indicator lights for providing an indication of the location of said mouse within said maze playing area.

* * * * *